US005609045A

United States Patent [19]

Schmoll et al.

[11] Patent Number: 5,609,045

[45] Date of Patent: Mar. 11, 1997

[54] LATCH NEEDLE FOR KNITTING MACHINES

[75] Inventors: Wolfgang Schmoll, Haigerloch-Owingen; Siegfried Wissmann, Albstadt-Pfeffingen, both of Germany

[73] Assignees: Theodor Groz & Söhne; Ernst Beckert Nadelfabrik Commandit-Gesellschaft, both of Albstadt, Germany

[21] Appl. No.: 623,707

[22] Filed: Mar. 29, 1996

[30] Foreign Application Priority Data

Apr. 1, 1995 [DE] Germany ..... 19512375

[51] Int. Cl.[6] ..... D04B 35/04

[52] U.S. Cl. ..... 66/121; 66/116

[58] Field of Search ..... 66/116, 119, 120, 66/121, 122, 123, 124, 114, 115

[56] References Cited

U.S. PATENT DOCUMENTS

| | | | |
|---|---|---|---|
| 3,031,867 | 5/1962 | Widerhut et al. | 66/121 |
| 4,512,164 | 4/1985 | Fukuhara | 66/121 |
| 4,601,180 | 7/1986 | Mayer et al. | 66/121 |
| 4,656,841 | 4/1987 | Mayer | 66/121 |

FOREIGN PATENT DOCUMENTS

| | | |
|---|---|---|
| 3335908 | 4/1984 | Germany . |
| 2714607 | 12/1993 | Germany . |
| 4324232 | 1/1995 | Germany . |

*Primary Examiner*—C. D. Crowder
*Assistant Examiner*—Larry D. Worrell, Jr.
*Attorney, Agent, or Firm*—Spencer & Frank

[57] ABSTRACT

A knitting needle includes a shank, a needle hook carried by the shank at one end thereof, and a sawslot provided in the shank. The sawslot is bordered by elastically deformable shank cheeks which are provided by upper supporting surfaces. The sawslot has a throughgoing aperture which is open toward the shank back. A latch rivet traverses the sawslot and is supported in the shank cheeks. A needle latch having a latch back provided with engagement faces is pivotally supported by the latch rivet for swinging motions between a closed position in which the needle latch engages the needle hook and an open position in which the engagement faces on the latch back lie on the supporting surfaces of the shank cheeks. The sawslot has, in a series as viewed from needle hook, a first sawslot portion containing the throughgoing aperture and a second sawslot portion having a width greater than the width of the first sawslot portion. The supporting surfaces are located in a zone of the second sawslot portion which has a depth greater than one half of the shank height and which is closed underneath the supporting surfaces. A third sawslot portion adjoins the second sawslot portion and has a width less than the width of the second sawslot portion.

8 Claims, 2 Drawing Sheets

LATCH NEEDLE FOR KNITTING MACHINES

CROSS REFERENCE TO RELATED APPLICATION

This application claims the priority of German Application No. 195 12 375.1 filed Apr. 1, 1995.

BACKGROUND OF THE INVENTION

This invention relates to a latch needle for knitwearmaking machines and is of the type which has a shank carrying a needle hook at one end. The shank is provided with a sawslot extending parallel to the shank length, and a needle latch is pivotally supported by a rivet disposed in the sawslot. In the region underneath the rivet, the sawslot has an aperture open at the back of the needle shank. The sawslot is bilaterally bounded by elastically deformable shank cheeks which, in the region of the upper edges of the sawslot, have supporting surfaces which cooperate with engagement faces provided on the latch back. Further, the sawslot is subdivided into portions of different widths.

To dampen the impact of the needle latch on the needle shank at the end of the reverse latch movement away from the needle hook to thus avoid damages to the needle and the latch particularly when the knitting machine operates at high speeds, it is known—as disclosed, for example, in German Patent No. 2,714,607—to design the latch-receiving sawslot in the shank such that a first, short sawslot portion (which contains the throughgoing aperture below the rivet) is adjoined by a second sawslot portion which projects beyond the end of the opened latch (when it is in its open, reverse position) and which is deeper than one-half the height of the needle shank. The supporting surfaces provided on the needle shank which cooperate with the engagement faces on the needle latch are situated above the second sawslot portion. By virtue of the cooperation of the needle shank cheeks flanking the sawslot, with the wedge-like converging flanks at the latch back, the shank cheeks, upon impact of the needle latch, are elastically spread apart while, at the same time, friction is generated at the supporting surfaces. In this manner a significant damping of the impact is achieved which ensures a gentle operation of both the latch and the needle shank. The wedge shape of the supporting surface on the latch back is obtained by rounding the latch back in the usual manner. Further, by virtue of this design the latch remains in the fully opened position and preserves its free mobility in this position, that is, the latch is not jammed between the cheeks of the needle shank.

A latch needle of the above-outlined type has been found to function in a highly satisfactory manner. It requires, however, a very accurate positioning and a particularly shaped design of the embossment which is pressed on the upper side of the needle shank and which constitutes the supporting surfaces for the needle latch. Further, as the needle shank thickens, the elastic deformability of the shank cheeks diminishes.

An essentially similar latch needle is disclosed in German Offenlegungsschrift (application published without examination) 33 35 908, according to which the sawslot is divided into first and second parts. The first part which is provided with a throughgoing aperture underneath the latch rivet, is dimensioned in its width in the usual manner and thus corresponds to the dimensions of the needle latch. The second sawslot part adjoins the first sawslot part on that side which is oriented away from the needle hook. The second sawslot part has a lesser width than the first sawslot part. The width of the narrower, second sawslot part is approximately 0.5 to 0.8 times the width of the first, wider sawslot part. The supporting surfaces for the latch back are arranged at the upper edges of the second, narrower sawslot part which too, has a throughgoing aperture opening at the needle back. The narrowing of the sawslot leads to correspondingly thicker shank cheeks and thus, to a reduced elastic deformability thereof.

To improve the elasticity of the shank cheeks in the region of the supporting surfaces for the latch back and to thus increase the desired dampening of the motion of the latch upon its impact on the engagement faces, in a latch needle known from German Offenlegungsschrift 43 24 232 a throughgoing aperture has been provided which fully separates the two shank cheeks and which extends from the supporting surfaces to the shank back. The width of the throughgoing aperture may be larger or smaller than or equal to the width of the sawslot in the region of the latch rivet. If such an aperture extends in the length dimension of the shank up to a location below the latch rivet—which is expedient to ensure a trouble-free lint removal—the danger exists that the latch support (latch bearing) becomes unstable. If, on the other hand, as it has been suggested in the alternative, at the needle back a bridge is provided underneath the latch rivet, then the lint removal is interfered with. The further suggested arrangement of two apertures extending in the longitudinal direction and being separated by a bridge at the needle back is not feasible partly because of the insufficient stability and partly because of manufacturing reasons.

SUMMARY OF THE INVENTION

It is an object of the invention to provide a latch needle which is an improvement over the latch needle disclosed in German Patent No. 2,714,602 in that the manufacturing requirements are less stringent as concerns the design of the supporting surfaces on the shank cheeks for the latch back and particularly in case of thick needles an increased damping effect is achieved to dampen the impact of the latch on the supporting surfaces on the needle shank without endangering the latch bearing.

This object and others to become apparent as the specification progresses, are accomplished by the invention, according to which, briefly stated, the knitting needle includes a shank, a needle hook carried by the shank at one end thereof, and a sawslot provided in the shank. The sawslot is bordered by elastically deformable shank cheeks which are provided by upper supporting surfaces. The sawslot has a throughgoing aperture which is open toward the shank back. A latch rivet traverses the sawslot and is supported in the shank cheeks. A needle latch having a latch back provided with engagement faces is pivotally supported by the latch rivet for swinging motions between a closed position in which the needle latch engages the needle hook and an open position in which the engagement faces on the latch back lie on the supporting surfaces of the shank cheeks. The sawslot has, in a series as viewed from needle hook, a first sawslot portion containing the throughgoing aperture and a second sawslot portion having a width greater than the width of the first sawslot portion. The supporting surfaces are located in a zone of the second sawslot portion which has a depth greater than one half of the shank height and which is closed underneath the supporting surfaces. A third sawslot portion adjoins the second sawslot portion and has a width less than the width of the second sawslot portion.

The width of the first sawslot part in the zone of the latch support (bearing) is conventionally coordinated with the dimensions of the needle latch in such a manner that the latter is movable without dampening and is laterally guided to the required extent. By virtue of the fact that the adjoining second sawslot part is wider, the shank cheek zones bounding this sawslot part have a greater elastic deformability, as a result of which even in case of thick needles, the impacting latch is dampened in a superior manner to the required extent for a high-speed operation. Because of the increased sawslot width in the region of the supporting surfaces as compared to the first sawslot portion, the supporting surfaces are correspondingly smaller, whereby an exact formation and positioning of the embossment constituting the supporting surfaces in the shank cheeks have only a subordinated significance because the flexible sawslot walls formed by the shank cheeks resiliently dampen the impact of the latch at the end of its reverse motion. Since the sawslot is closed underneath the supporting surfaces and the length of the throughgoing aperture which is open at the shank back underneath the latch bearing needs to be of a length which takes into consideration only a satisfactory lint removal, the latch needle according to the invention has a superior stability.

The third sawslot portion which adjoins the wide, second sawslot portion at its end oriented away from the needle head (hook) is designed to be narrower for taking into account the stability of the needle. The result is a laterally yielding support of the narrow and highly flexible shank cheeks in the region of the second, wide sawslot portion.

The supporting surfaces for the latch back are located expediently well above the lowest point or the lowest region of the second sawslot portion, that is, they are arranged in a region in which, as a rule, optimum elastic deformation conditions prevail for the shank cheeks. The length of the second sawslot portion may be selected according to requirements; it projects in most cases beyond the end of the open needle latch lying on the supporting surfaces provided on the needle shank. Advantageously, the bottom wall of at least the second sawslot portion is arcuately curved in the longitudinal direction of the needle shank. The arrangement, however, may be such that the second and/or the third sawslot portion, in the vicinity of the throughgoing aperture which is open at the needle back, is bounded by a substantially linear surface region which is adjoined by a curved surface region that runs off to the upper side of the shank.

Thus, the selection of the width of the first sawslot portion is determined by the dimensions of the needle latch, whereas in the second and third sawslot portions the respective width is selected dependent from the needle dimensions such that the optimum dampening properties for the needle latch are obtained. In practice it has been found that a ratio of the width of the first sawslot portion to the width of the second sawslot portion is frequently expedient to be in the range of approximately 2:3 to 2:5, whereas the ratio of the width of the third sawslot portion to the width of the second sawslot portion is advantageously in the range of approximately 7:4 to 7:6.5. These ratios, however, are not limiting; in individual cases other width ratios may be more advantageous.

DESCRIPTION OF THE PREFERRED EMBODIMENT

Figure 1:
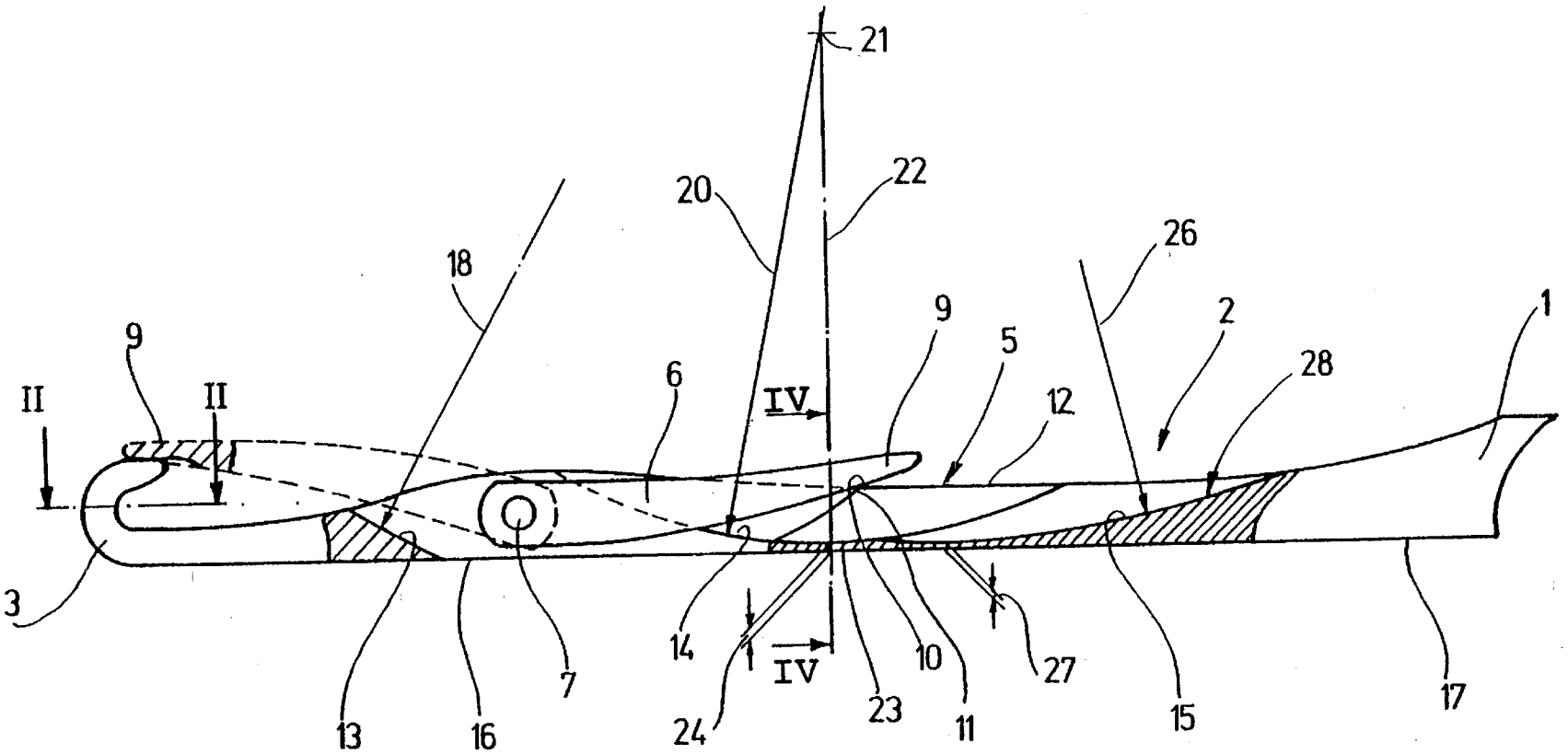
FIG. 1 is a fragmentary sectional side elevational view of a latch needle according to a preferred embodiment of the invention.

The latch needle illustrated in the Figures is stamped from a steel ribbon and has a shank 1 which is, at one end, adjoined, with the intermediary of a groove 2, by a needle head (needle hook) 3. The shank 1 is conventionally provided with at least one non-illustrated needle butt. Further, in the shank 1 an elongated sawslot 5 is provided which is symmetrical to the longitudinal plane of symmetry 4 of the shank 1 and in which a needle latch 6 is pivotally supported by a rivet 7. The rivet 7 may be formed either as bearing pins/pressed inwardly from the plane of the shank cheeks 8 bilaterally bounding the sawslot 5 or may be a separate cylindrical bearing pin held at its opposite ends in the shank cheeks 8. At its end oriented away from the rivet 7 the latch 6 has a latch spoon (noucat) 9 which, when the latch 6 is closed, forms a nest for the tip of the needle head 3 as shown in broken lines in FIG. 1.

The latch 6 is pivotal between a closed position shown in broken lines in FIG. 1 and a fully open or reverse position shown in solid lines in FIG. 1. In the reverse position the latch 6 lies, with engagement faces 10 provided on the back of the latch spoon 9, on the supporting surfaces 11 provided on the needle shank 1 in the region of the upper edges 12 of the sawslot 5.

The deepened supporting surfaces 11 situated bilaterally of the sawslot 5 are formed in the shank 1 by die impressions and are of a shape to conform to the engagement faces 10 at the back of the latch spoon 9. The engagement faces 10 on the back of the latch spoon 9 are designed as wedge-like converging flanks. In some instances, the usual rounding of the back of the latch spoon 9 is sufficient for this purpose.

The sawslot 5 is subdivided into three parts 13, 14 and 15 which, as viewed from the needle head 3, are arranged in series along the shank length.

Figure 2:
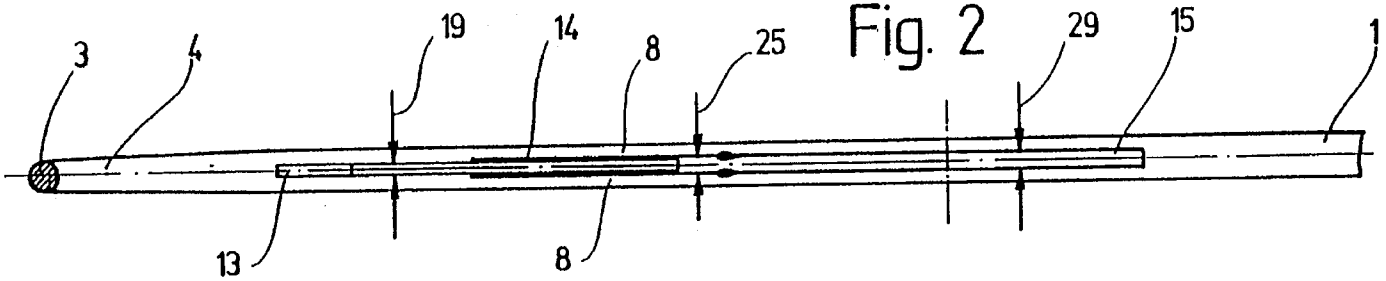
FIG. 2 is a top plan view of the latch needle shown in FIG. 1, wherein parts are removed along the section line II—II of FIG. 1.
Figure 3:
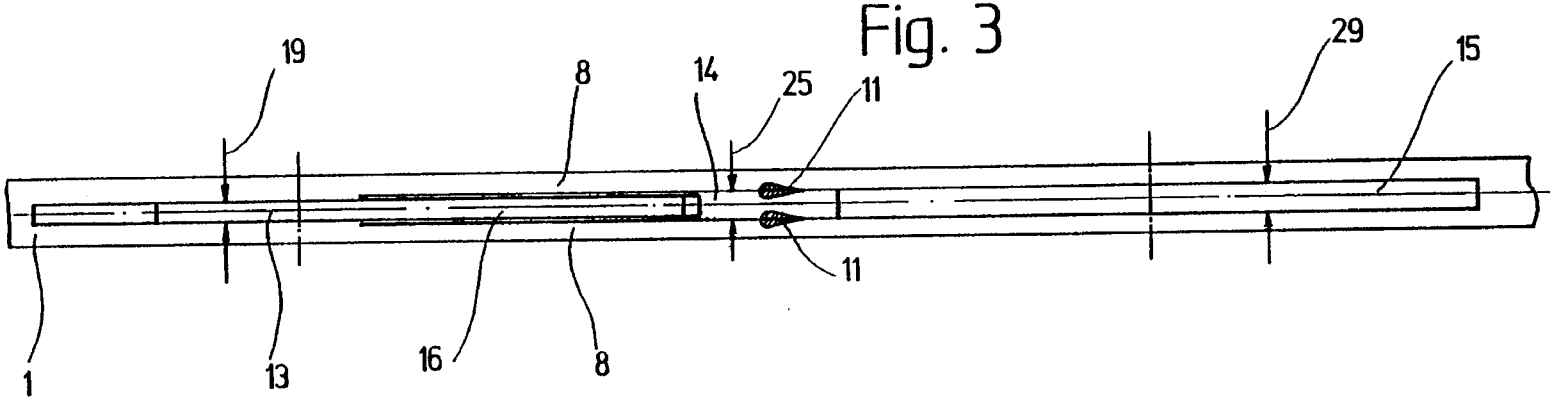
FIG. 3 is a fragmentary top plan view similar to FIG. 2, shown on an enlarged scale.
Figure 4:
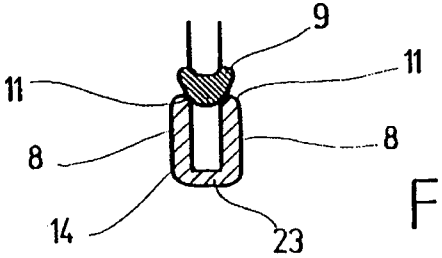
FIG. 4 is a sectional view taken along line IV—IV of FIG. 1, illustrated on an enlarged scale.

The first sawslot portion 13 contains the latch rivet 7 and has, underneath the latch rivet 7, an aperture 16 opening towards the shank back 17. The first sawslot portion 13 has a circularly arcuate bottom, whose radius of curvature is designated at 18 in FIG. 1. The width of the first sawslot portion 13 designated at 19 in FIGS. 2 and 3 is, dependent upon the width dimensions of the latch 6, selected such that the latch 6 is laterally guided by the side walls of the first sawslot portion 13 during its undampened pivotal motion about the latch rivet 7. Such a lateral guidance ensures that in the closed position of the latch 6, the latch spoon 9 lies on the tip of the needle hook 3 as designed.

The second sawslot portion 14 has a bottom which is likewise circularly arcuate and whose radius of curvature is designated at 20 in FIG. 1. The center point 21 of the radius of curvature 20 is situated on an imaginary line 22 which is oriented perpendicularly to the shank back 17 in the region of the two supporting surfaces 11 formed in the zone of the second sawslot portion 14. The second sawslot portion 14 is deeper than one-half of the shank height and is closed adjacent the aperture 16 toward the shank back 17 by a web-like shank portion 23 whose minimum height 24 lies on the imaginary line 22. By virtue of this construction the two supporting surfaces 11 are situated above the lowest (deepest) location of the second sawslot portion 14.

The width of the second sawslot portion 14 designated at 25 in FIGS. 2 and 3 is substantially greater than the width 19 of the first sawslot portion 13. The ratio of the width 19 of the first sawslot portion 13 to the width 25 of the second sawslot portion 14 is in the range of approximately 2:3 to 2:5, preferably 2:3.

The length of the second sawslot portion 14 extending parallel to the length of the shank 1 is dimensioned such that the second sawslot portion 14 projects beyond the end of the latch 6 situated in its reverse position in a manner shown in FIG. 1, while on the opposite side the second sawslot portion 14 extends to the vicinity of the rivet 7. The length depends from the properties of the latch needle, particularly the shank height and the shank thickness.

The third sawslot portion 15, similarly to the first and second sawslot portions 13 and 14, also has a bottom of circularly arcuate configuration; its radius of curvature which is designated at 26, is, as a rule, substantially greater (twice or more) than the radius of curvature 18 of the first sawslot portion 13 and the radius of curvature 20 of the second sawslot portion 14. It is noted that the two radii of the curvature 18 and 20 are, as a rule, approximately the same or the radius of curvature 20 of the second sawslot portion 14 is by 10 to 40% greater than the radius of curvature 18 of the first sawslot portion 13. The third sawslot portion 15 is closed towards the shank back 17 and constitutes a prolongation of the web-like shank portion 23 formed by the second sawslot portion 14. The minimum height 27 is in the order of magnitude of the minimum height 24 of the second sawslot portion 14 so that there is obtained, in a manner shown in FIG. 1, an overall, essentially flat surface region which borders the two sawslot portions 14, 15 at the bottom side along the web-like shank portion 23 and its prolongation. The flat surface region is adjoined by a curved surface region 28 by means of which the third sawslot portion 15 joins the upper side of the needle shank 1.

It will be understood that in principle it is also feasible that the bottom of the sawslot portions 13, 14 and 15 may have a shape that is other than exactly circularly arcuate; the sawslot bottoms may thus be sectionwise planar which is obtained by moving the sawslot-producing milling tool in the longitudinal direction of the needle shank 1.

The third sawslot portion 15 is narrower than the second sawslot portion 14. The width 29 (FIGS. 2 and 3) of the third sawslot portion 15 is so selected that the ratio of the width 29 of the third sawslot portion 15 to the width 25 of the second sawslot portion 14 is in the range of approximately 7:4 to 7:6.5. The length of third sawslot portion 15 is selected with a view toward achieving the desired elastic deformability in the zone of the supporting surfaces 11. The third sawslot portion 15, however, always projects in the longitudinal direction beyond the wider, second sawslot portion 14.

During operation the latch 6, with the wedge-like converging engagement faces 10 on the back of the latch spoon 9, strikes the supporting surfaces 11 of the needle shank 1. Since the supporting surfaces 11 are arranged in the region of the particularly wide second sawslot portion 14, that is, in a region in which the shank cheeks 8 are thinner and thus more elastic, the impact of the latch 6 is absorbed in a highly satisfactory manner. Because of the increased distance of the two supporting surfaces 11 from one another, resulting from the greater sawslot width, the latch back may penetrate accordingly deeper into the sawslot portion 14 so that an exact position of the shaped embossments forming the supporting surfaces 11 is only of lesser importance. These effects are optimized in that the supporting surfaces 11, as noted before, are situated immediately above the deepest location 24 of the curved sawslot portion 14 or, in case of a linear sawslot portion, above the deepest bottom region.

The construction of the sawslot 5 according to the invention as described above, having three sawslot portions 13, 14 and 15 of different widths is intended particularly for heavy duty needles for large and small circular knitting machines, and more particularly for needles having a more substantial needle thickness, such as approximately 0.48 mm and above. It will be understood, however, that the invention may find application in latch needles having a lesser thickness.

It will be further understood that the above description of the present invention is susceptible to various modifications, changes and adaptations, and the same are intended to be comprehended within the meaning and range of equivalents of the appended claims.

What is claimed is:

1. In a knitting needle including a shank having a length, a height perpendicular to said length, opposite ends, a shank back and an upper shank side opposite said shank back;

a needle hook carried by said shank at one of said ends thereof;

a sawslot provided in said shank; said sawslot extending in said length dimension and being bordered by elastically deformable shank cheeks provided by upper supporting surfaces; said sawslot having a throughgoing aperture being open toward said shank back;

a latch rivet traversing said sawslot and supported in said cheeks; and a needle latch having a latch back provided with engagement faces; said needle latch being pivotally supported by said latch rivet for swinging motions between a closed position in which said needle latch engages said needle hook and an open position in which said engagement faces on said latch back lie on said supporting surfaces of said shank cheeks;

the improvement wherein said sawslot comprises, in a series as viewed from said needle hook, (a) a first sawslot portion containing said throughgoing aperture and having a width;

(b) a second sawslot portion having a width greater than the width of said first sawslot portion; said supporting surfaces being located in a zone of said second sawslot portion; said second sawslot portion having a depth greater than one half of said height of said shank and being closed underneath said supporting surfaces; and (c) a third sawslot portion adjoining said second sawslot portion and having a width less than the width of said second sawslot portion.

2. The knitting needle as defined in claim 1, wherein said second sawslot portion projects beyond said needle latch in said open position thereof.

3. The knitting needle as defined in claim 1, wherein said supporting surfaces are situated essentially above a deepest location of said second sawslot portion.

4. The knitting needle as defined in claim 1, wherein said second sawslot portion has a bottom curving parallel to said length of said shank.

5. The knitting needle as defined in claim 1, wherein said second sawslot portion has a substantially planar bottom part adjacent said throughgoing aperture.

6. The knitting needle as defined in claim 1, wherein said third sawslot portion has a substantially planar bottom part adjacent said throughgoing aperture; further comprising a bottom portion curving parallel to said length and terminating at said upper shank side.

7. The knitting needle as defined in claim 1, wherein a ratio of the width of said first sawslot portion to the width of said second sawslot portion is approximately 2:3 to 2:5.

8. The knitting needle as defined in claim 1, wherein a ratio of the width of said third sawslot portion to the width of said second sawslot portion is approximately 7:4 to 7:6.5.

* * * * *

UNITED STATES PATENT AND TRADEMARK OFFICE

CERTIFICATE OF CORRECTION

PATENT NO. : 5,609,045
DATED : March 11, 1997
INVENTOR(S) : Wolfgang Schmoll et al It is certified that error appears in the above-indentified patent and that said Letters Patent is hereby corrected as shown below:

On the title page, item [73], the sole assignee's name should read --Theodor Groz & Söhne & Ernst Beckert Nadelfabrik Commandit-Gesellschaft--.

Signed and Sealed this

Fifteenth Day of July, 1997

*Attest:*

*Attesting Officer*

BRUCE LEHMAN

*Commissioner of Patents and Trademarks*